US007764147B2

(12) United States Patent
Koizumi et al.

(10) Patent No.: US 7,764,147 B2
(45) Date of Patent: Jul. 27, 2010

(54) COPLANAR RESONATOR AND FILTER USING THE SAME

(75) Inventors: Daisuke Koizumi, Zushi (JP); Kei Satoh, Yokosuka (JP); Shoichi Narahashi, Yokohama (JP)

(73) Assignee: NTT DoCoMo, Inc., Tokyo (JP)

( * ) Notice: Subject to any disclaimer, the term of this patent is extended or adjusted under 35 U.S.C. 154(b) by 247 days.

(21) Appl. No.: 11/514,085

(22) Filed: Sep. 1, 2006

(65) Prior Publication Data

US 2007/0052502 A1 Mar. 8, 2007

(30) Foreign Application Priority Data

Sep. 6, 2005 (JP) ..... 2005-258373

(51) Int. Cl.
*H01P 3/08* (2006.01)

(52) U.S. Cl. ..... 333/204

(58) Field of Classification Search ..... 333/204
See application file for complete search history.

(56) References Cited

U.S. PATENT DOCUMENTS

2003/0222737 A1* 12/2003 Mordkovich ..... 333/204
2005/0088259 A1 4/2005 Satoh et al.
2005/0206480 A1 9/2005 Satoh et al.

FOREIGN PATENT DOCUMENTS

JP 06-029707 2/1994
JP 08-056106 2/1996
JP 11-220304 8/1999

OTHER PUBLICATIONS

Yu-Kang Kuo, et al., "Novel Reduced-Size Coplanar-Waveguide Bandpass Filters", IEEE Microwave and Wireless Components Letters, vol. 11, No. 2, XP-011038694, Feb. 2001, pp. 65-67.
Jiafeng Zhou, et al., "Coplanar Quarter-Wavelength Quasi-Elliptic Filters Without Bond-Wire Bridges", IEEE Transactions on Microwave Theory and Techniques, vol. 52, No. 4, XP-001192731, Apr. 2004, pp. 1150-1156.
Thomas M. Weller, et al., "Compact stubs for micromachined coplanar waveguide", Proceedings of the 25th European Microwave Conference 1995, vol. 2, Conf. 25, XP-000681796, Sep. 4, 1995, pp. 589-593.
Shry-Sann Liao, et al., "Novel Reduced-Size Coplanar-Waveguide Bandpass Filter Using the New Folded Open Stub Structure", IEEE Microvawe and Wireless Components Letters, vol. 12, No. 12, XP-001141158, Dec. 2002, pp. 476-478.

* cited by examiner

*Primary Examiner*—Rexford N Barnie
*Assistant Examiner*—Thienvu V Tran
(74) *Attorney, Agent, or Firm*—Oblon, Spivak, McClelland, Maier & Neustadt, L.L.P.

(57) ABSTRACT

A coplanar resonator which is comprised of a dielectric substrate, a center conductor formed in the surface thereof, and a ground conductor formed so as to surround the same center conductor, wherein the same center conductor is comprised of a main line conductor 31, formed by extension in a rectilinear shape, and auxiliary line conductors 32*a* and 32*b* bifurcating from at least one end of the same main line conductor, folding back and being extended on both sides of the main line conductor.

9 Claims, 16 Drawing Sheets

COPLANAR RESONATOR AND FILTER USING THE SAME

TECHNICAL FIELD

This invention pertains to a coplanar resonator, used mainly in the microwave band and the millimeter wave band, and a filter using the same, as well as a reduction in size of the same.

BACKGROUND ART

Conventionally, it has been common for a resonator using coplanar lines formed on a plane circuit substrate and a filter using the same to be constituted by having a plurality of lines arranged. As a technology reducing the size of resonators and filters using these coplanar lines, there is known the technology, disclosed in Patent Reference 1, of eliminating lumped-parameter elements for coupling, and devised so that the lines forming a λ/4 resonator (λ being a wavelength) can be directly arranged in series.

In FIG. 20, an example of a filter using coplanar lines shown in Patent Reference 1. Filter 200 consists of a series connection of four λ/4 coplanar resonators Q1, Q2, Q3, and Q4 patterned by photolithography-based etch processing of a ground conductor 202 provided by means of vapor deposition or sputtering over the entire surface of a dielectric substrate 201 formed as a rectangular plate.

The four λ/4 coplanar resonators Q1, Q2, Q3, and Q4 are formed by center conductors 203, 204, 205, and 206, having an electric length corresponding to ¼ of the wavelength of the used frequency, which are formed on the center line in the longitudinal direction of rectangular plate shaped dielectric substrate 201, and ground conductor 202 formed by leaving a spacing of a gap g20 on both sides in the extended direction thereof.

One end of center conductor 203 of λ/4 coplanar resonator Q1 is connected to the grounded ground conductor 202 and has an input/output terminal P1 derived from the extension direction of center conductor 203 on one longitudinal direction side of dielectric substrate 201.

Opposite the other end of center conductor 203 forming resonator Q1 via a capacitive coupling part C1 due to a gap g21, one end of center conductor 204 forming resonator Q2 is arranged with the same width as that of center conductor 203. The other end of center conductor 204 is electrically connected to ground conductor 202 on both longitudinal direction sides of center conductor 204 by means of rectilinear line conductors 207 and 208 and forms an inductive coupling part L1. Via linear line conductors 207 and 208 which constitute this inductive coupling part L1, the other end of center conductor 204 (one end of center conductor 205) is extended as is and center conductor 205 constituting resonator Q3 is formed.

Opposite the other end of center conductor 205 forming resonator Q3 via a capacitive coupling part C2 based on a gap g22, one end of center conductor 206 forming resonator Q4 is arranged with the same width as that of center conductor 205, the other end of center conductor 206 being electrically connected to ground conductor 202 and there being derived, from an extension direction of center conductor 206, an input/output terminal P2 on one longitudinal direction side of dielectric substrate 201, so that a filter is constituted.

Patent Reference 1: Japanese Patent Application Laid Open No. 1999-220304 (FIG. 1)

DISCLOSURE OF THE INVENTION

Problem to be Solved by the Invention

However, in order to configure a filter by connecting in series a plurality of coplanar resonators with a technology such as mentioned above, there has been the problem that, with an integral multiple of the resonator size, the total length of the filter ends up becoming great. E.g., with a dielectric constant of 9.68 and taking the thickness to be 0.5 mm, the resonator length becomes approximately 6.4 mm if a λ/4 coplanar resonator is built. In the aforementioned example, since four resonators are connected in series, the total length ends up becoming 25.6 mm, even for a minimal length not including input/output terminals. A filter like this is used e.g. in base stations for mobile communications and is arranged right next to the antenna. As for the filter used in a base station, it sometimes occurs, with the object of reducing losses, that the whole filter is cooled and used in a superconducting state. In a case like this, there is a need to reduce the size as much as possible of the whole filter including the cooling device, in order to diminish the air resistance due to winds at the installation site. Also, if the filter is small, it is sufficient for the cooling capacity of the cooling device to be small as well. A component miniaturized in this way is demanded.

As one method responding to the same request, there has already been proposed a filter such as shown in FIG. 21, with a structure in which the center conductors are lined up in a meander shape. The filter shown in FIG. 21 has center conductors which repeat the bends in a direction at right angles with the signal input/output direction to shorten the total length in the output/input direction. Only the portions in which the center conductors bend are different, and the other parts are entirely the same as in the configuration of the filter in FIG. 20 previously explained, in which four λ/4 coplanar resonators are connected in series, so the reference numerals are taken to be the same and an explanation thereof is omitted.

If the path length is increased of the center conductors in the direction at right angles with the signal input/output direction, it is possible to shorten the total filter length in the input/output direction, but there has been the problem that the size in the direction at right angles with the input/output direction becomes greater.

This invention is one which takes points like this into consideration and has for its object to propose a coplanar resonator and a filter which can be more reduced in size than with conventional technology.

Means for Solving the Problem

The coplanar resonator of this invention has been devised so that the center conductor is comprised of two types of elements: a main line conductor and auxiliary line conductors which bifurcate at least at one end of the same main line conductor and which are extended by being folded back on both sides of the main line conductor.

Effects of the Invention

Due to the coplanar resonator of this invention, since the line length of the center conductor becomes the total of the line lengths of a main conductor, arranged in parallel with the direction of signal propagation, and auxiliary line conductors which bifurcate at least at one end of the same line conductor, it is possible to shorten the length of the resonator in the direction of signal propagation to the extent of the folded back auxiliary line conductors. Consequently, it is possible to reduce the size of the coplanar resonator and the coplanar filter.

DETAILED DESCRIPTION OF THE INVENTION

Hereinafter, embodiments of this invention will be explained with reference to the drawings.

First Working Mode

Figure 1A:
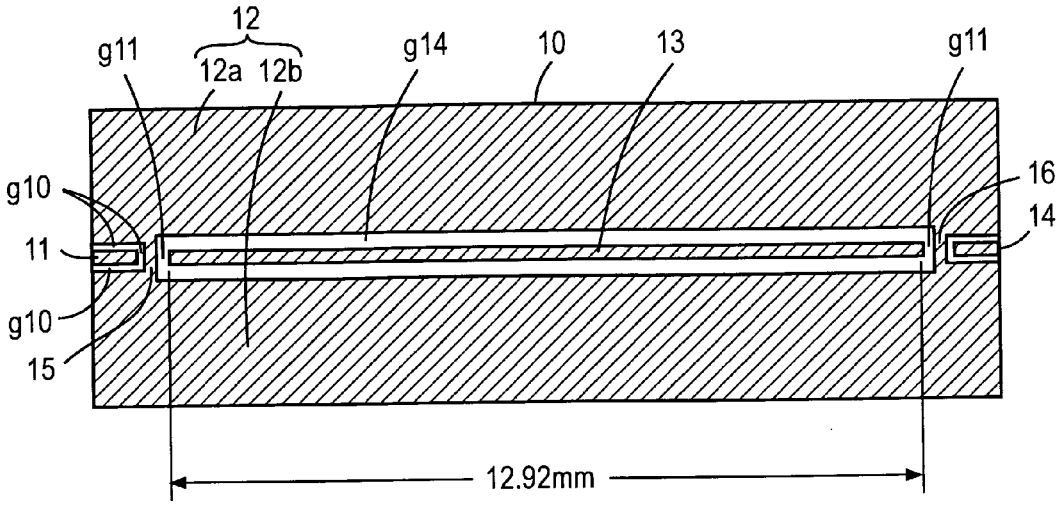
FIG. 1A PRIOR ART
FIG. 1A is a diagram showing a conventional half-wavelength resonator.
Figure 1B:
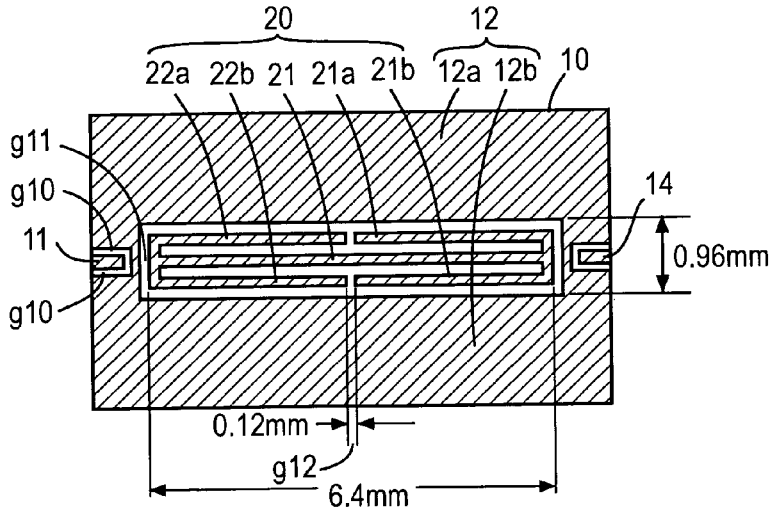
FIG. 1B is a diagram showing a half-wavelength coplanar resonator of this invention.
Figure 1C:
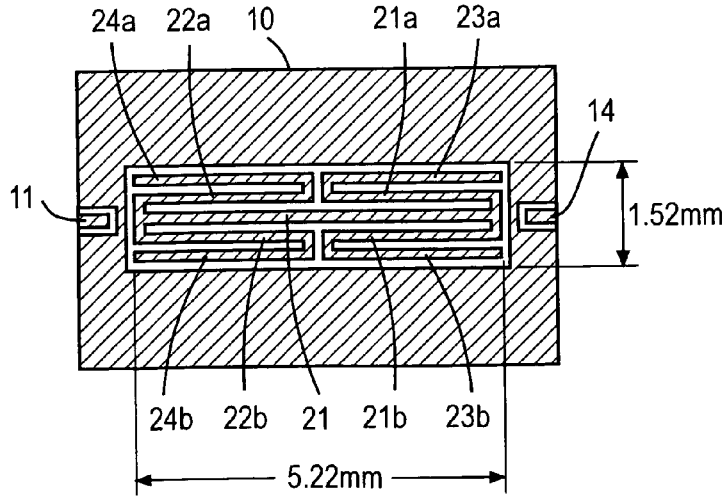
FIG. 1C is a diagram showing a half-wavelength coplanar resonator of this invention.

As the first working mode of this invention, half-wavelength coplanar resonators of this invention are shown in FIG. 1B and FIG. 1C. The half-wavelength coplanar resonators of this invention shown in FIG. 1B and FIG. 1C are resonators in which the center conductor of the conventional half-wavelength coplanar resonator shown in FIG. 1A has been modified.

FIG. 1A is a plan view taken from right above of the electrode structure formed on the surface of a rectangular plate shaped dielectric substrate 10. In the middle portion of a short side of dielectric substrate 10, a rectangular shaped input/output terminal 11 is arranged, a spacing of a gap g10 is left on both long sides of the same input/output terminal 11, and ground conductors 12*a*, 12*b* connected to the ground potential are formed. On the inner side of the substrate of input/output terminal 11, there is formed a short circuit part 15 connecting ground conductors 12*a* and 12*b* by leaving a spacing which is the same as gap g10, and further, there is left a spacing of a gap g11 which faces one end of center conductor 13 and has the same spacing as input/output terminal 11.

Center conductor 13 constitutes the resonant element of the half-wavelength resonator, and if for dielectric substrate 10, the dielectric constant is e.g. taken to be 9.68, the thickness 0.5 mm and the resonant frequency 5 GHz (hereinafter, these conditions will be identical), the line length thereof will be 12.92 mm. Center conductor 13 is arranged rectilinearly in the longitudinal direction of the rectangular plane shape.

On both outer longitudinal direction sides of center conductor 13, ground conductors 12*a*, 12*b* are arranged by leaving a spacing of a gap g14, bigger than that of gap g10 of the input/output terminal 11 portion. On the side of the other end of center conductor 13, there are arranged a short circuit part 16, formed into the same shape as the first short side of dielectric substrate 10 by leaving the same spacing as g11, and an input/output terminal 14.

In this way, the half-wavelength coplanar resonator is constituted in a shape where a center conductor 13 with a prescribed length is surrounded, centered thereon, by ground conductors 12*a* and 12*b* on both outer sides thereof. Further, the shapes of input/output terminals 11 and 14 depend on the design of how the power level of the input or output signal or the strength of coupling with center conductor 13 is chosen. Also, there was shown an example of capacitive coupling wherein input/output terminals 11 and 14 and center conductor 13 are coupled by means of an electrostatic capacitance $C_1$ due to gap g11, but even regarding the coupling of this portion, there are cases where the parts are coupled by inductive coupling not going through the gap, so FIG. 1A does not go beyond showing an example.

Next, there will be explained an embodiment of a half-wavelength resonator according to this invention which is shown in FIG. 1B.

First Embodiment

The center conductor of the half-wavelength resonator of this invention, shown in FIG. 1B, differs from that previously shown in FIG. 1A in the point of being constituted by means of two types of lines, that of a main line conductor and that of auxiliary line conductors into which the same main line conductor has at least one end folded back and extended. Specifically, in the embodiment of FIG. 1B, a center conductor 20 consists of a main line conductor 21 extended in the longitudinal direction of dielectric substrate 10 and auxiliary line conductors 21*a*, 21*b* and 22*a*, 22*b* which respectively bifurcate at both ends of the same line conductor 21 and are folded back and extended in an L shape. Since other points are the same as for the resonator shown in FIG. 1A, the reference numerals are taken to be the same and an explanation thereof is not repeated.

Leaving a spacing of gap g11 with ground conductors 12*a* and 12*b*, both end parts of main line conductor 21, arranged on the surface of the same rectilinear dielectric substrate 10, bifurcate toward a direction at right angles with the direction of input/output terminals 11 and 14. After bifurcation, both end parts which are extended by a fixed length are folded back in parallel with line conductor 21, auxiliary line conductors 21*a* and 21*b* being formed on one end side of main line conductor 21 and auxiliary line conductors 22*a* and 22*b* being formed on the other end side.

As shown in FIG. 1B, in the case where center conductor 20 is devised to consist of main line conductor 21 and auxiliary line conductors 21*a*, 21*b*, 22*a*, and 22*b*, the line length acting as a resonating element is designed with the length of main line conductor 21 as the parameter, and auxiliary line conductor 21*a* and auxiliary line conductor 21*b* are designed to have the same length. Specifically, the shape of the line conductors becomes one with a line symmetry having the center line of main line conductor 21 in the longitudinal direction as the central axis.

An exemplification will be shown of a resonator with the same resonant frequency as that of the conventional resonator shown in FIG. 1A and designed to have the shape shown in FIG. 1B. E.g., if a design is carried out assuming a width of 0.16 mm for main line conductor 21 and auxiliary line conductors 21*a*, 21*b*, 22*a*, and 22*b*, a spacing of 0.12 mm between ground conductors 12*a*, 12*b* and the auxiliary line conductors, and a spacing of 0.12 mm between main line conductor 21 and the auxiliary line conductors, it is possible to design the length of the resonant element in the direction between input/output terminals 11 and 14 to be 6.4 mm.

In the explanation hereinafter, the length of a line conductor is defined to be the length at the center of the width thereof. The length of the line of main line conductor 21 is (6.4−0.16) mm=6.24 mm and the length of the auxiliary line conductors in a direction at right angles with the extension direction at both ends of main line conductor 21 is (2×(0.12+0.08+0.08)) mm=0.56 mm. If the total of the lengths of the portions auxiliary line conductors 21*a* and 22*a* which run parallel to main line conductor 21 is taken to be ((6.4−0.16−0.12)/2) mm=3.06 mm, the line length from the tip of auxiliary line conductor 21*a*, constituting the line length of the resonant element, to the tip of auxiliary line conductor 22*a* via main line conductor 21 becomes (6.24+0.56+2×3.06) mm=12.92 mm, so in the case of this example, the line length of the resonant element becomes the same as in the example of FIG. 1A. It is a coincidence that it became the same line length, and it is not necessarily the same length as in FIG. 1A.

At this point, the tip of auxiliary line conductor 21*a* and the tip of auxiliary line conductor 22*a* are facing each other leaving a gap g12 of 0.12 mm. Also, the spacing between ground conductors 12*a* and 12*b* in a direction at right angles with the extension direction of main line conductor 21 becomes 0.96 mm. This size of the direction at right angles with the straight line joining input/output terminals 11 and 14 becomes big, but in this case, the size is small at 0.96 mm, so it is possible to include it amply within the scope of sizes for manufacturing a plane circuit on the surface of dielectric substrate 10 with good efficiency or sizes needed for giving it sufficient strength. All things considered, it is possible to implement a resonator for which the resonant element length has been shortened from 12.92 mm to 6.4 mm, without increasing the size in the direction at right angles with the direction of signal propagation.

Second Embodiment

Embodiment 2, of a half-wavelength coplanar resonator according to this invention wherein the number of foldbacks of the auxiliary line conductors has been increased and the size in the direction of signal propagation has been further reduced, is shown in FIG. 1C.

This embodiment is a variation of the embodiment of FIG. 1B, and as shown in FIG. 1C, auxiliary line conductors 21*a* and 22*a* (21*b* and 22*b*) bend, before making contact at the center portion of main line conductor 21, in a direction away from main line conductor 21, at right angles with main line conductor 21, and, after extension by a fixed length, there are formed, parallel to main line conductor 21 and auxiliary line conductors 21*a*, 21*b*, 22*a*, and 22*b* and folded back, auxiliary line conductors 23*a*, 23*b*, 24*a*, and 24*b*.

By carrying out a foldback twice in this way, it is possible to further reduce the size of the resonant element to 5.22 mm. However, by increasing the number of foldbacks, the size in a direction at right angles with the direction of signal propagation increases from 0.96 mm to 1.52 mm. This number of foldbacks is a design item which is determined depending on the allowable dielectric substrate size and can be set arbitrarily.

The distinguishing feature of this invention resides in the fact that the center conductor of the resonator consists of a main line conductor and auxiliary line conductors implemented by folding back and extending at least at one end of the same main line conductor. The characteristics of a resonator formed in that way and shown in FIGS. 1B and 1C will be explained in the following.

Half-Wavelength Resonator Characteristics

Figure 2:
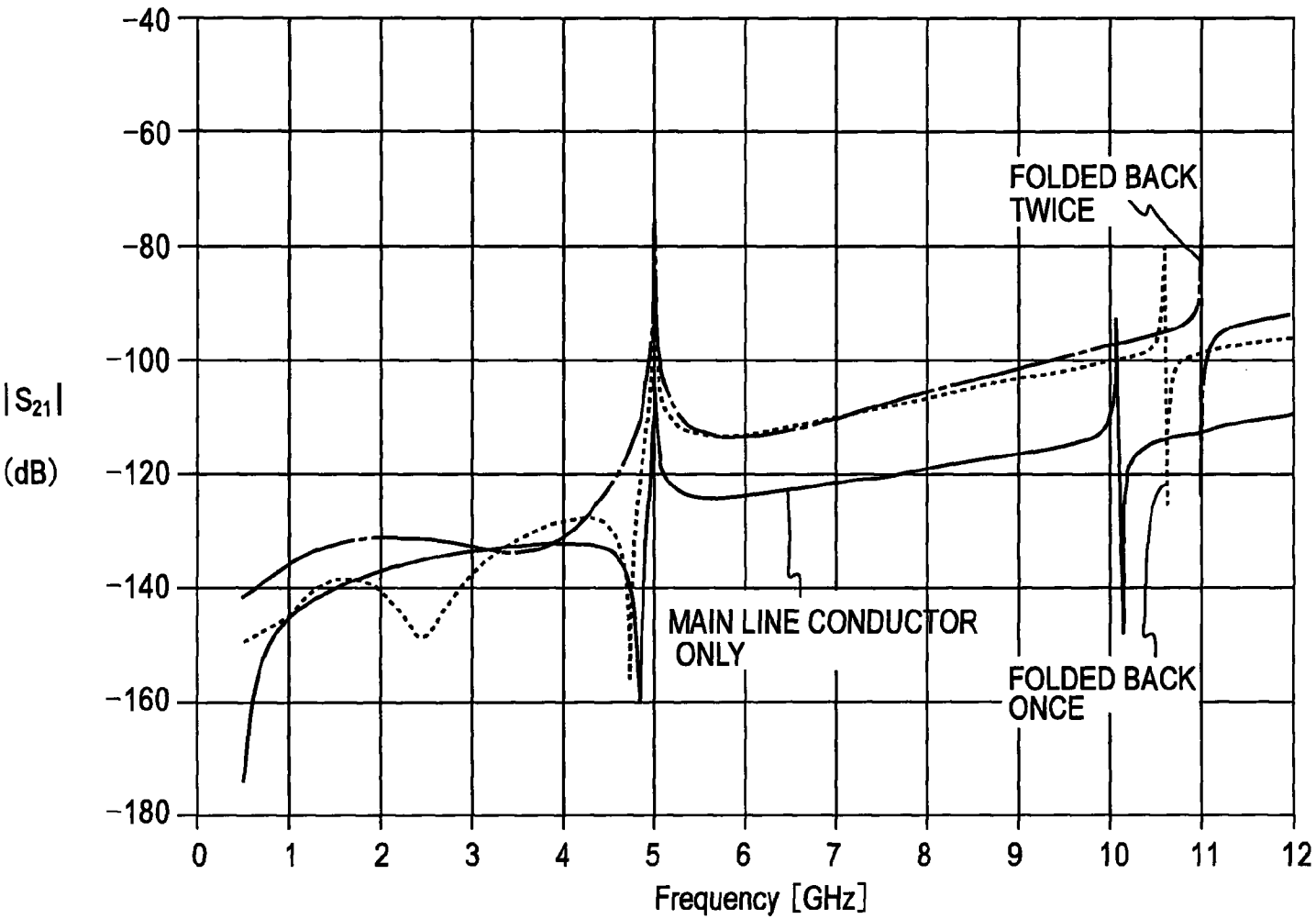
FIG. 2 is a diagram showing the frequency characteristics of a half-wavelength resonator.

The frequency characteristics of the resonators shown in FIGS. 1A, 1B, and 1C are shown in FIG. 2. The abscissa of FIG. 2 represents frequency (in GHz) and the ordinate represents the $S_{21}$ parameter (in dB) which expresses the ratio of signal transmission between the input and the output. The graduations of the ordinate are expressed as −40 dB to −180 dB. Regarding these values, since FIG. 2 is a simulation result aimed at analyzing resonant frequencies, the size of the values does not have much significance. It is a characteristic which has significance for relative changes. The relationship of the abscissa and the ordinate in the drawings showing the frequency characteristics of the resonators shown hereinafter is the same, and hereafter, an explanation thereof will be omitted.

The characteristics of a conventional resonator having a center conductor with a linear shape, shown in FIG. 1A, are indicated with a solid line. Frequency characteristics are shown with a resonant frequency, at which $S_{21}$ becomes big, at 5 GHz and a spurious frequency of approximately 10.05 GHz. As against these characteristics, the characteristics of the resonator of this invention folded back once, shown in Embodiment 1 (FIG. 1B), are indicated with a broken line. It shows a resonant frequency of 5 GHz, a value in conformity with the design, the spurious frequency occurring at approximately 10.56 GHz. Further, the characteristics of the resonator folded back twice, shown in Embodiment 2 (FIG. 1C) are indicated with a dash and dot line. These characteristics also have a resonant frequency unchanged at 5 GHz, the spurious frequency being shifted to a yet higher frequency, which occurs at 10.99 GHz.

In this way, even a resonator in which the center conductor is constituted by a main line conductor and folded back auxiliary line conductors shows frequency characteristics which are the same as for a conventional resonator.

Second Working Mode

Figure 3A:
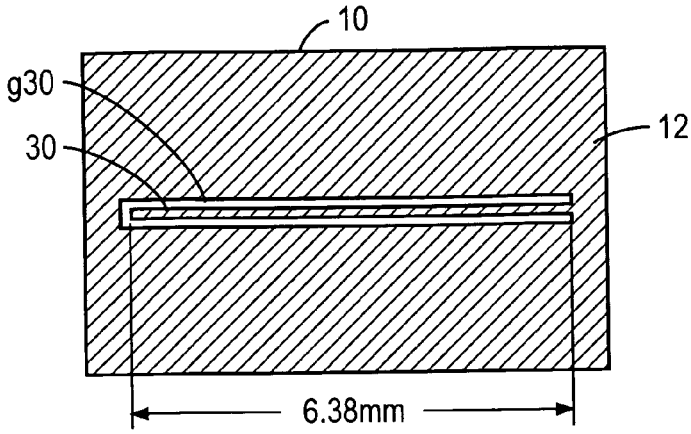
FIG. 3A PRIOR ART
FIG. 3A is a diagram showing a conventional λ/4 coplanar resonator.
Figure 3B:
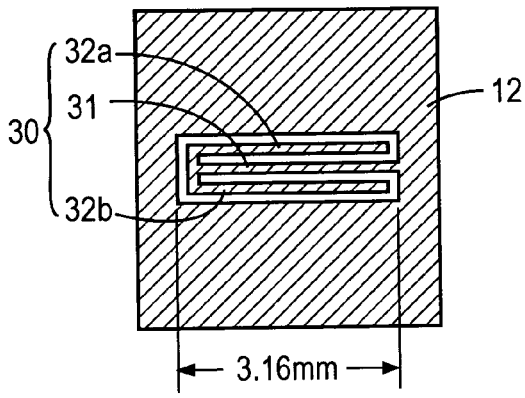
FIG. 3B is a diagram showing a λ/4 coplanar resonator of this invention.
Figure 3C:
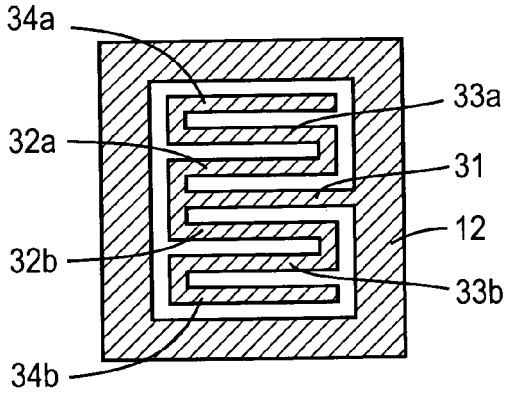
FIG. 3C is a diagram showing a λ/4 coplanar resonator of this invention.
Figure 3D:
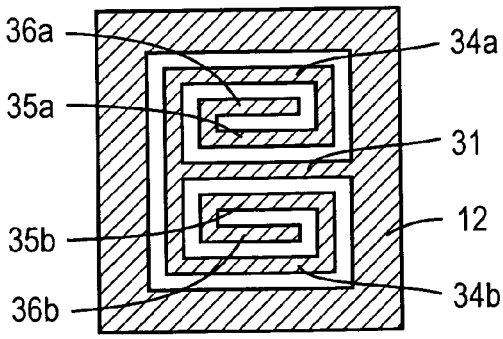
FIG. 3D is a diagram showing a λ/4 coplanar resonator of this invention.

As a second working mode, λ/4 coplanar resonators of this invention are shown in FIGS. 3B, 3C, and 3D. FIG. 3A is a conventional λ/4 coplanar resonator. In FIGS. 3A to 3D, the designs are expressed omitting the input/output terminals inputting and outputting the signals in the same way as in FIGS. 1A, 1B, and 1C. The λ/4 coplanar resonator shown in FIG. 3A, having a center conductor 30 one end of which is electrically connected to ground conductor 12, is connected to ground. The length of the center conductor, taken to have a resonant frequency of 5 GHz, is 6.38 mm, and both outer sides in the extension direction of the same center conductor 30 are enclosed, via a gap g30 with a spacing of 0.12 mm, by ground conductor 12.

Third Embodiment

Embodiment 3 of this invention is shown in FIG. 3B. FIG. 3B is a λ/4 coplanar resonator and has a shape in which the ends on the side of the clearance end of center conductor 30 in FIG. 3A bifurcate and are folded back. A main line conductor 31, one end of which is electrically connected to ground conductor 12, has its other end bifurcate at right angles with the extension direction of main line conductor 31. After bifurcation, both end parts, extended by a fixed length, are folded back in parallel with main line conductor 31 to form auxiliary line conductors 32*a* and 32*b*.

As shown in FIG. 3B, in case the center conductor is constituted by a main line conductor 31 and auxiliary line conductors 32*a* and 32*b*, the line length acting as a resonant element becomes the sum of the lengths of main line conductor 31 and the length of auxiliary line conductor 32*a*, or the sum of main line conductor 31 and the length of auxiliary line conductor 32*b*. The design is carried out so that the sums become the same.

Specifically, the line conductor shape becomes one with line symmetry in the center axis of the center line in the longitudinal direction of main line conductor 31. This is the same as the structure on one side of the half-wavelength resonator which has already been explained and is shown in FIG. 1B.

If a resonator having the same resonant frequency as the conventional resonator shown in FIG. 3A is designed with the shape shown in FIG. 3B, and with the same conditions on the line width and the spacing to the ground conductor as in the example described above, the length in the extension direction of main line conductor 31, i.e. the length in the direction of signal propagation of the λ/4 resonant element, can be designed to be 3.16 mm.

Fourth Embodiment

Embodiment 4, shown in FIG. 3C, is an embodiment in which the length in the extension direction of main line conductor 31 has been reduced by further increasing the number of foldbacks. The tips of auxiliary line conductors 32*a* and 32*b* are bent to the side making contact with ground conductor 12, at right angles with the extension direction of main line conductor 31, toward a direction in which they are mutually separated and after having been extended by a fixed length, second foldbacks are carried out so that auxiliary line conductors 33*a* and 33*b* which are extended in parallel along auxiliary line conductors 32*a* and 32*b* are formed. When the folded back auxiliary line conductors 33*a* and 33*b* are extended to reach a fixed length, third foldbacks are carried out, and there are formed auxiliary line conductors 34*a* and 34*b* which are extended in parallel, along auxiliary line conductors 33*a* and 33*b*.

By increasing the number of foldbacks in this way, it is possible to further shorten the length in the extension direction of main line conductor 31.

Fifth Embodiment

Embodiment 5, in which the shape of the auxiliary line conductors has been chosen to have a vortex shape, is shown in FIG. 3D. The example shown in FIG. 3C is one where each foldback is carried out from a bent part of the auxiliary line conductors in a direction away from main line conductor 31, while in FIG. 3D, the shape of the auxiliary line conductors are chosen to have a vortex shape by choosing the foldback directions to be in alternately opposite directions.

The other end of main line conductor 31 intersects the extension direction of main line conductor 31 at right angles and, after bifurcating toward mutually deviating directions and after being extended so as to form comparatively long lines, both end parts of the lines are folded back in parallel with main line conductor 31, and auxiliary line conductors 34*a* and 34*b* are formed. Auxiliary line conductors 34*a* and 34*b* are extended and, on the side of making contact with ground conductor 12, intersect at right angles with the extension direction, are bent in a direction approaching main line conductor 31 and, after being extended by a prescribed length, are folded back in parallel with main line conductor 31, and auxiliary line conductors 35*a* and 35*b* are formed. Auxiliary line conductors 35*a* and 35*b* are extended and on the side of making contact with auxiliary line conductors 34*a* and 34*b*, intersect at right angles with the extension direction, are bent in a direction away from main line conductor 31, and after being extended by a prescribed length, are folded back in parallel with main line conductor 31, and auxiliary line conductors 36*a* and 36*b* are formed.

In this way, by alternately changing the foldback direction, the shape of the auxiliary line conductors becomes vortex-shaped.

If the directions of bending and extending the auxiliary conductors are changed, the shapes of the auxiliary line conductors change, but by designing the combined line length of the main line conductor and the auxiliary line conductor to be a desired length, it is possible to constitute a λ/4 resonator of arbitrary frequency.

Characteristics of the λ/4 Resonator

Figure 4:
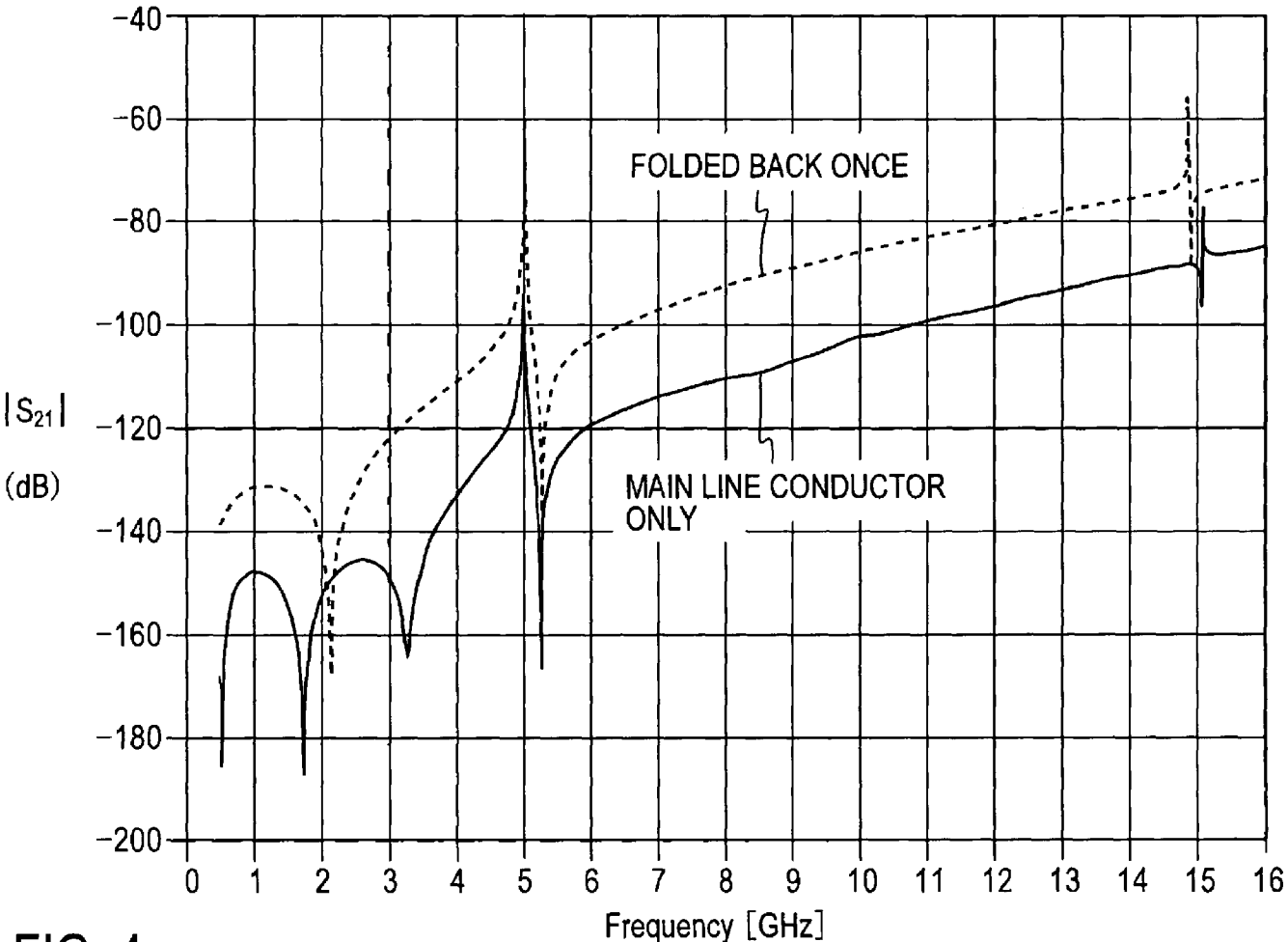
FIG. 4 is a diagram showing the frequency characteristics of a λ/4 coplanar resonator.

The frequency characteristics of the resonators shown in FIG. 3A and FIG. 3B are shown in FIG. 4. The characteristics of the conventional λ/4 resonator shown in FIG. 3A are indicated with a solid line. The characteristics of a resonator of this invention, based on auxiliary line conductors folded back once and a main line conductor, are indicated with a broken line.

The solid line and the broken line at the same time indicate a resonant frequency of 5 GHz. As for the spurious frequency, the conventionally shaped λ/4 resonator showed a value of approximately 15.09 GHz and the resonator of this invention showed a value of approximately 14.89 GHz, nearly the same value. In this way, even with a resonator constituted by a center conductor based on the folded back auxiliary line conductors and the main line conductor of this invention, characteristics which are the same as for a conventional resonator are shown.

Here, one may notice that there appears a difference of approximately 17 dB in the value of $S_{21}$ between the two in the frequency range of 6 to 15 GHz. Concerning the analysis regarding this, it is something which is due to the fact that there have been changes, in the state of coupling between the excitation lines corresponding to the input/output terminals exciting the resonant element and the resonant element, accompanying changes in the shape of the resonant element, and it has no particular significance. This is a characteristic which has significance only in the relative change on the ordinate of each characteristic.

Sixth Embodiment

By increasing the line width of the clearance end sides of auxiliary line conductors 32*a* and 32*b* of the λ/4 resonator of this invention, shown in FIG. 3B, it is possible to further reduce the size, in the extension direction, of main line conductor 31. The embodiment thereof, Embodiment 6, is shown in FIG. 5.

Figure 5:
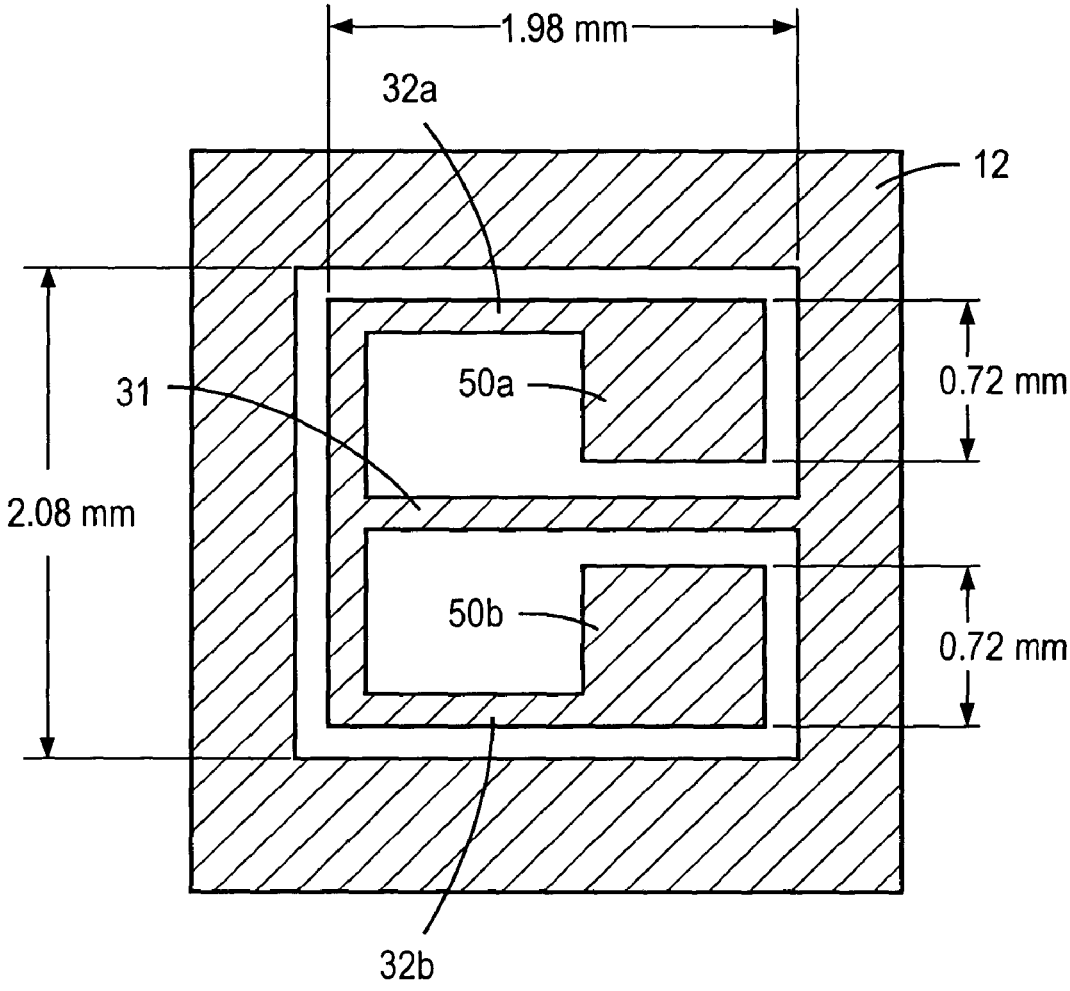
FIG. 5 is a diagram showing Embodiment 6 of this invention.

As shown in FIG. 5, the clearance end part of auxiliary line conductors 32*a* and 32*b* have wide-width parts 50*a* and 50*b* approaching the adjacent line conductor 31. By increasing the width of the clearance end parts of auxiliary line conductors 32*a* and 32*b*, the same frequency characteristics as in FIG. 3B can be obtained even if the length, in the extension direction, of main line conductor 31 is chosen to be 1.98 mm, as shown in FIG. 5. At this point, the spacing of ground conductor 12 in a direction at right angles with the extension direction of main line conductor 31 is 2.08 mm.

Figure 6:
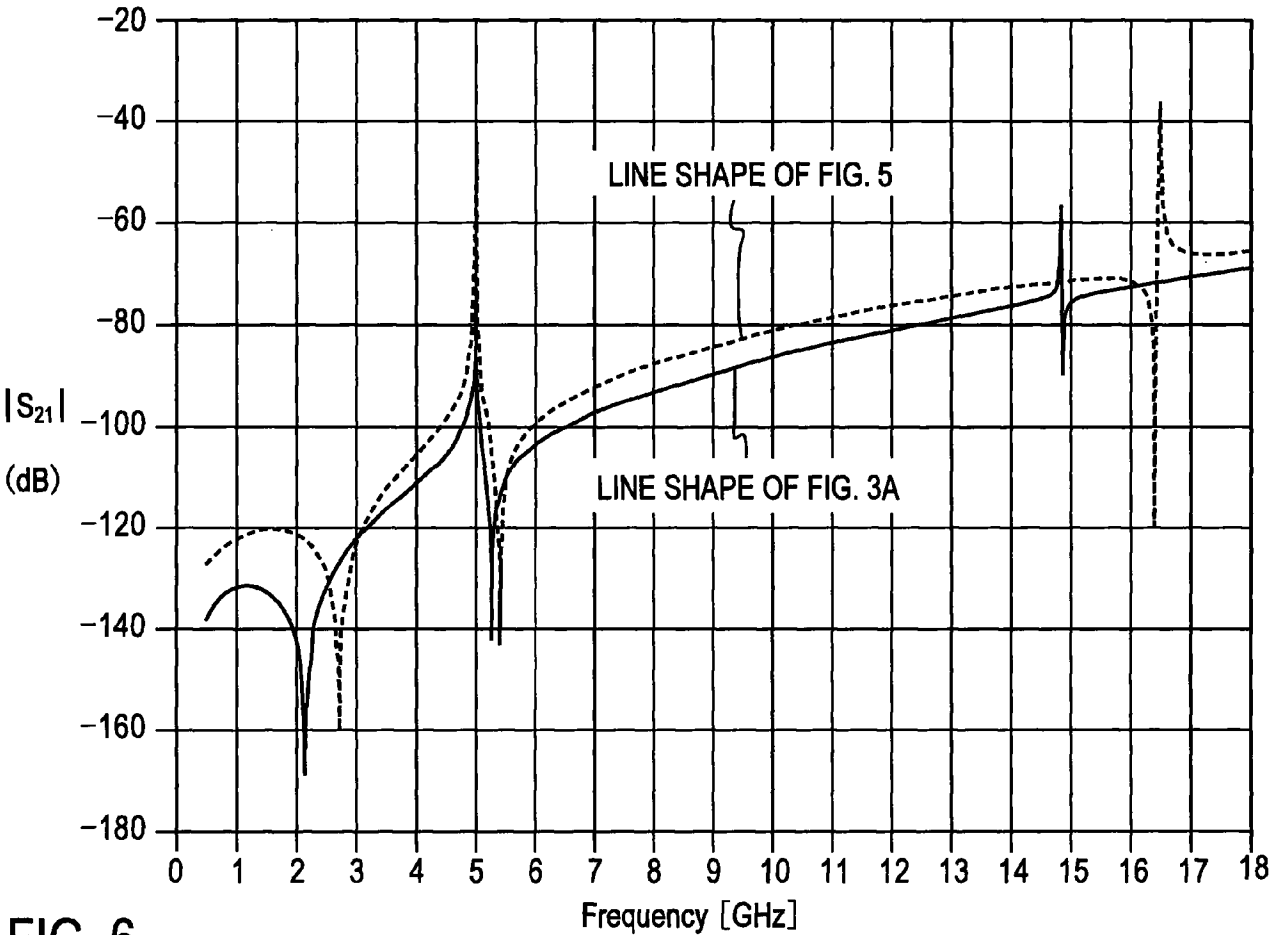
FIG. 6 is a diagram showing the frequency characteristics of the resonator of Embodiment 6 of this invention.

In FIG. 6, the frequency characteristics of the λ/4 resonator shown in FIG. 3B are indicated with a solid line and the frequency characteristics of the resonator shown in FIG. 5 are indicated with a broken line. The resonant frequencies together show a value of 5 GHz and the spurious frequency changes from 14.89 GHz to 16.55 GHz for the resonator provided with wide-width parts 50*a* and 50*b*, so the latter resonator exhibits excellent characteristics.

It may be considered that the reason why the same resonant frequency can be obtained even if the length, in the extension direction, of main line conductor 31 is shortened from 3.16 mm to 1.98 mm is that, by changing the line width in a step shape in the middle of auxiliary line conductors 32*a* and 32*b*, the structure becomes one of stepped impedance in which the line impedance changes with a step shape and the electrostatic capacitance between wide-width parts 50*a* and 50*b* and ground conductor 12 increases.

Seventh Embodiment

Even by providing a linear inserted ground conductor part in which line conductors are folded back and extended from the ground conductor and inserted between the main line conductor and the auxiliary line conductors, or between the auxiliary line conductors, it is possible to reduce the size of the resonator.

Figure 7:
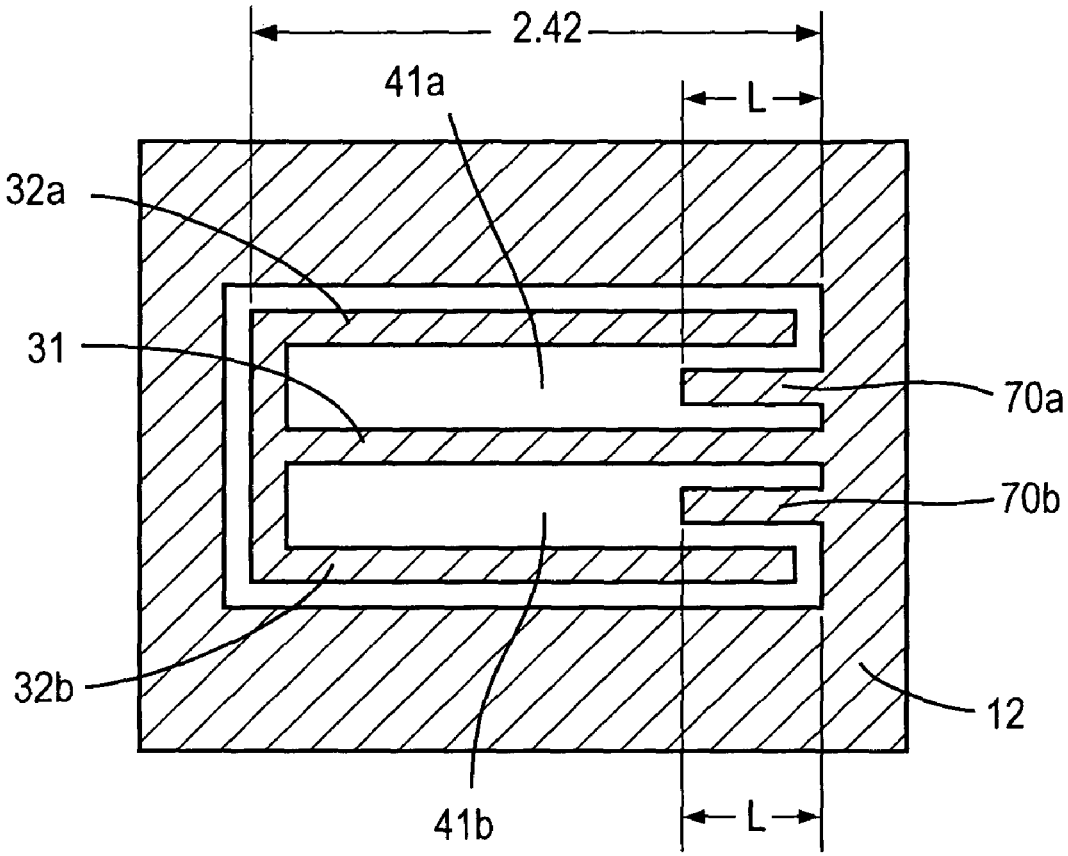
FIG. 7 is a diagram showing Embodiment 7 of this invention.

Embodiment 7, provided with this linear inserted ground conductor part, is shown in FIG. 7. Since the basic shape of the line conductor in FIG. 7 is the same as that in FIG. 3B which has already been explained, the reference numerals are taken to be the same as in FIG. 3B. The point of difference of Embodiment 7 from FIG. 3B is that a linear inserted ground conductor part 70*a* is extended from ground conductor 12 and inserted into a bay 41*a* formed between main line conductor 31 and auxiliary line conductor 32*a* and that a linear inserted ground conductor part 70*b* is extended from ground conductor 12 and inserted into a bay 41*b* formed between main line conductor 31 and auxiliary line conductor 32*b*.

By varying the length L of these linear inserted ground conductor parts 70*a* and 70*b*, it is possible to modify the resonant frequency. The frequency characteristics when changing the length L from the portion where one end of main line conductor 31 is connected to ground conductor 12 to 1.20 mm, 1.60 mm, 2.00 mm, and 2.14 mm are shown in FIG. 8.

Figure 8:
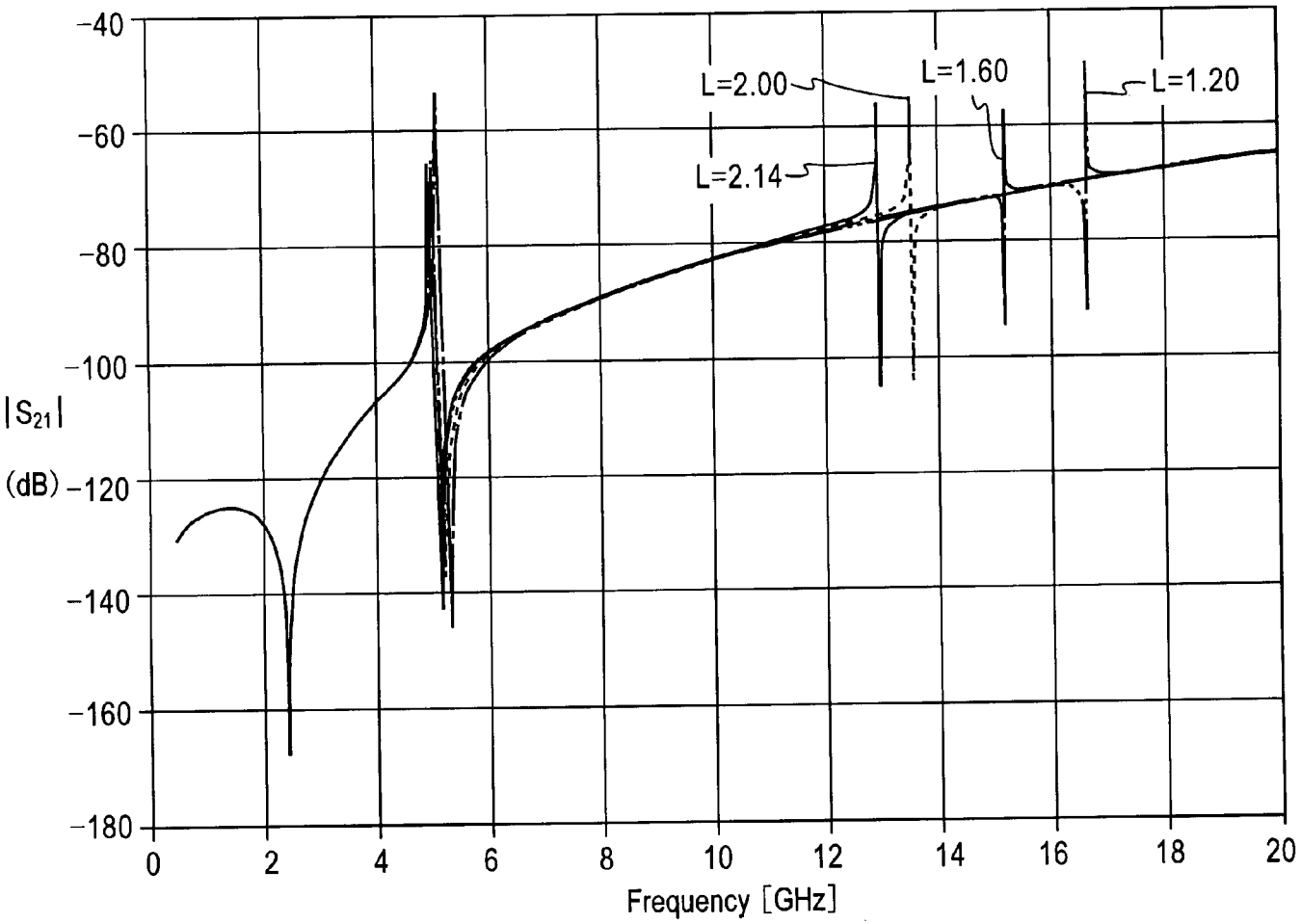
FIG. 8 is a diagram showing the frequency characteristics of the resonator of Embodiment 7 of this invention.

In FIG. 8, the point can be perceived that the resonant frequency on the order of 5 GHz barely changes as a function of changing L and the point that the spurious frequency changes greatly. The spurious frequency is approximately 16.67 GHz when L=1.20 mm, approximately 15.25 GHz when L=1.60 mm, approximately 13.56 GHz when L=2.00 mm and 12.97 GHz when L=2.14 mm, so a tendency is shown that the more L is increased, the more the spurious frequency decreases. As L is increased, the spurious frequency decreases, but since there is a sufficient frequency difference from the resonant frequency, it is not the case that this becomes a problem in use.

Figure 9:
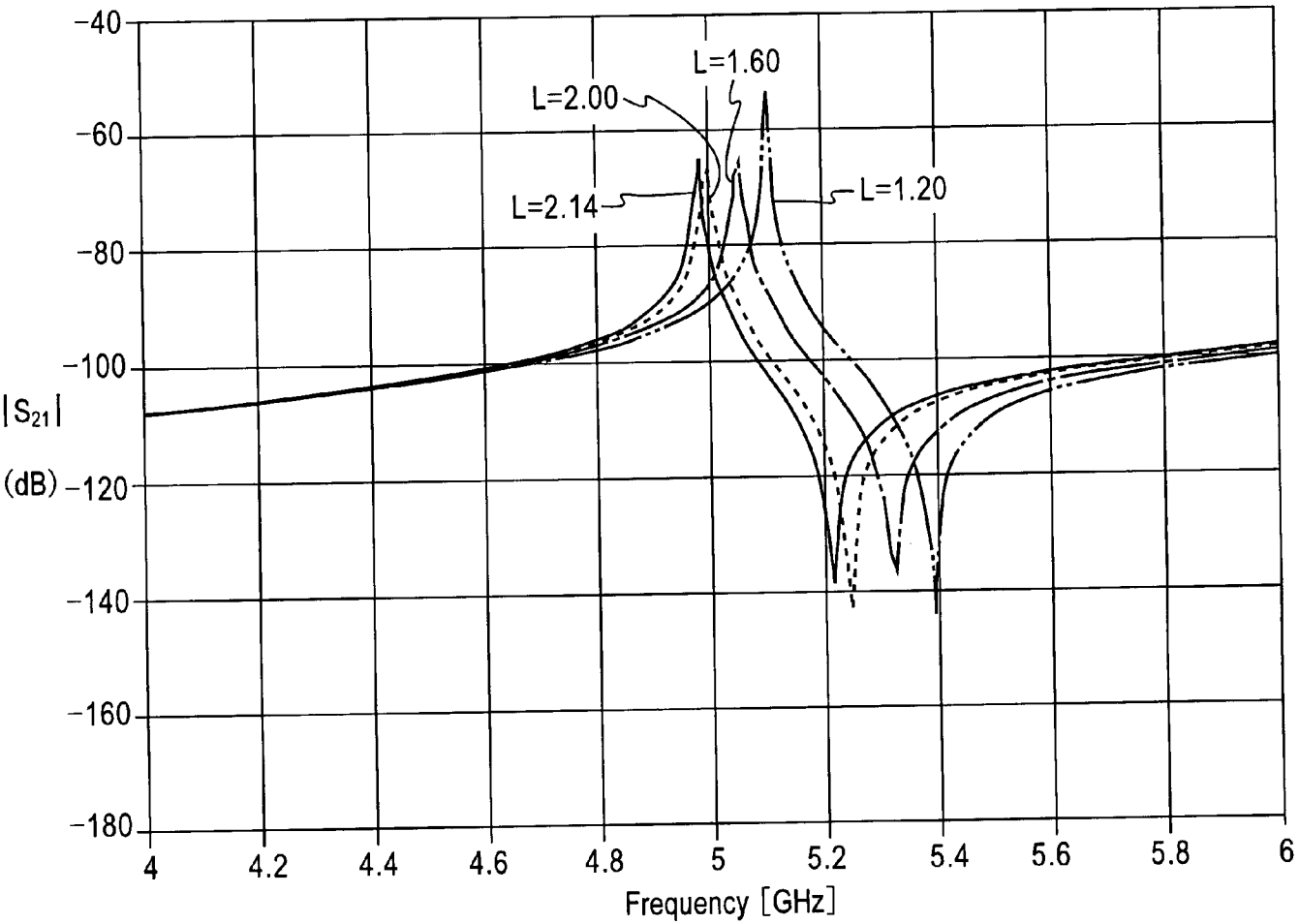
FIG. 9 is a diagram showing the frequency characteristics of the resonance frequency of the resonator of Embodiment 7 of this invention.

An enlarged diagram of the ordinate range of 4 to 6 GHz in FIG. 8 is shown in FIG. 9. The resonant frequency is approximately 5.11 GHz when L=1.20 mm, approximately 5.06 GHz when L=1.60 mm, approximately 5.01 GHz when L=2.00 mm, and approximately 4.99 GHz when L=2.14 mm, so a tendency is shown that the more L is increased, the more the resonant frequency decreases.

In this way, even if the dimensions of main line conductor 31 and auxiliary line conductors 32*a* and 32*b* are identical, by increasing the length L of linear inserted ground conductor parts 70*a* and 70*b*, it is possible to lower the resonant frequency. This is to say that it means that it is possible to reduce the size of the resonator by means of the linear inserted ground conductor part.

A respective combination of the aforementioned wide-width parts and linear inserted ground conductor parts is possible. Embodiments in which wide-width parts and linear inserted ground conductor parts have been combined will be shown in the following.

Eighth Embodiment

Figure 10A:
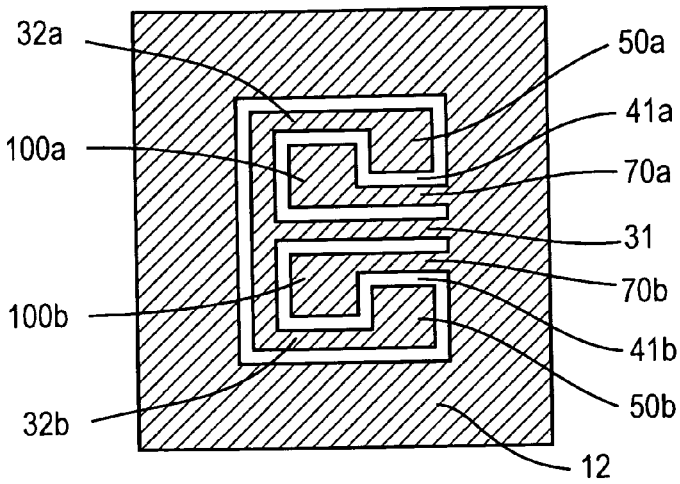
FIG. 10A is a diagram showing Embodiment 8 of this invention.

Embodiment 8, in which there have been provided linear inserted ground conductor parts with the line shape of the clearance end parts of auxiliary line conductors 32*a* and 32*b* shown in FIG. 5 is shown in FIG. 10. In FIG. 10A, corresponding to wide-width parts 50*a* and 50*b* of the auxiliary line conductors, the width is enlarged on the side of the clearance ends of linear inserted ground conductor parts 70*a* and 70*b* penetrating into bays 41*a* and 41*b* and inserted ground conductor wide-width parts 100*a* and 100*b* are formed.

Embodiment 9

Figure 10B:
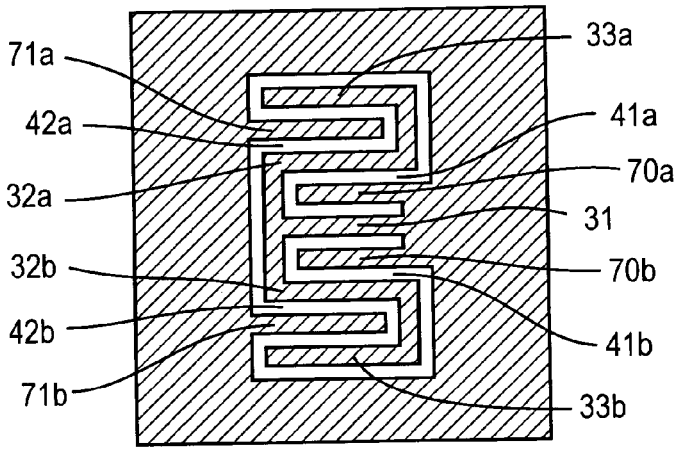
FIG. 10B is a diagram showing Embodiment 9 of this invention.

Embodiment 9 is shown in FIG. 10B. FIG. 10B is a diagram where, in a resonator of a type in which the auxiliary line conductors shown in FIG. 3C are bent in a direction at right angles with the extension direction of main line conductor 31 and away from main line conductor 31, linear inserted ground conductor parts 70*a*, 70*b* are inserted into bays 41*a* and 41*b* formed between main line conductor 31 and auxiliary line conductors 32*a* and 32*b*, and linear inserted ground conductor parts 71*a* and 71*b* are inserted into bays 42*a* and 42*b* formed between auxiliary line conductors 32*a* and 32*b* and auxiliary line conductors 33*a* and 33*b*.

Embodiment 10

Figure 10C:
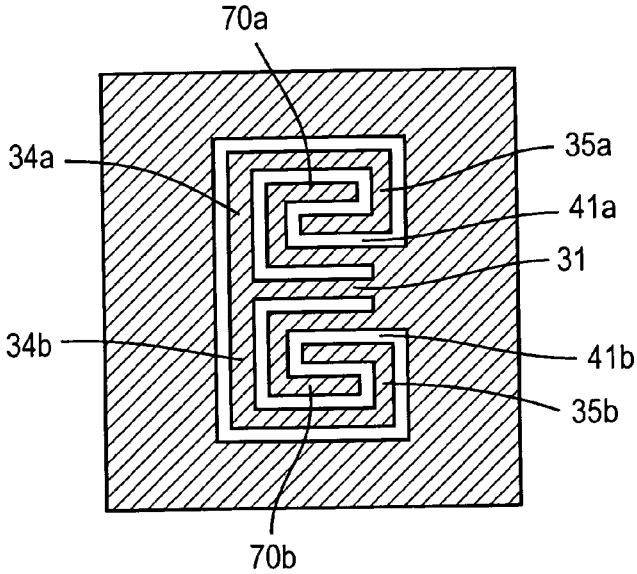
FIG. 10C is a diagram showing Embodiment 10 of this invention.

Embodiment 10 is shown in FIG. 10C. FIG. 10C is a diagram where, in a resonator of a type in which auxiliary line conductors are formed in a vortex shape by the fact that the bending directions of the auxiliary line conductors shown in FIG. 3D change alternately, hook-shaped inserted ground conductor parts 70*a* and 70*b* are provided inside hook-shaped bays 41*a* and 41*b* formed by main line conductor 31, auxiliary line conductors 34*a* and 34*b*, and auxiliary line conductors 35*a* and 35*b*.

In the foregoing, there have been shown various shapes of resonant elements constituting the resonators of Embodiments 1 to 10, but as for the junction parts between the main line conductors and ground conductors and the bent parts of the auxiliary line conductors mentioned this far, the examples shown have all been examples with right angles. As for the coplanar resonators and coplanar filters mentioned until now, there are cases where, with the purpose of making losses very small, the whole resonator (filter) is cooled and used in a superconducting state. At that time, it sometimes occurs that the current density of each portion of the resonator (filter) becomes a problem.

If there is a particularly high current concentration even in one portion of a resonator (filter), the superconducting state may end up collapsing for that reason. Assuming a case like that, a line conductor shape can be considered in which it is difficult for current concentration to be generated.

Figure 11A:
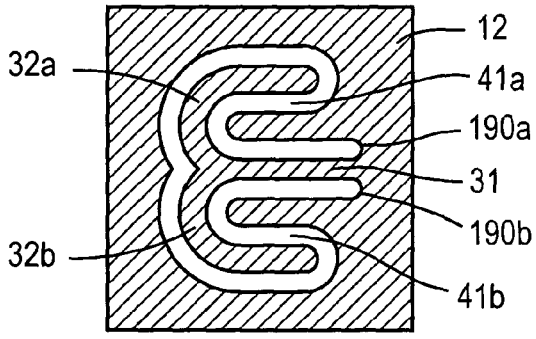
FIGS. 11A to 11D are diagrams showing resonant elements in which the coupling part and the folded back part of the line conductor of the resonant elements shown in FIG. 7 and FIGS. 10A to 10C have been devised to have an arcuate shape.

FIG. 11A is a diagram where, together with both sides of the connection part, to ground conductor 12 of main line conductor 31 in FIG. 3B which has already been explained, being arcuately shaped and mutually becoming wider toward the exterior, the folded back parts of the auxiliary line conductors have been made into an arcuate shape. The reference numerals are the same as in FIG. 3B. Here, the portions where current concentration can be particularly observed are source portions 190*a* and 190*b* of main line conductor 31 into which the current flows from ground conductor 12 to main line conductor 31. By making these portions arcuately shaped, it is possible to alleviate the current concentration. It is effective to further choose the folded back parts to be arcuately shaped.

Figure 11B:
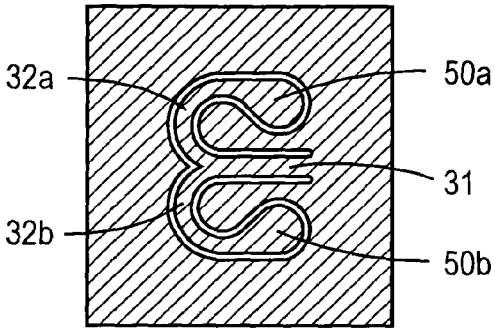
Figure 11C:
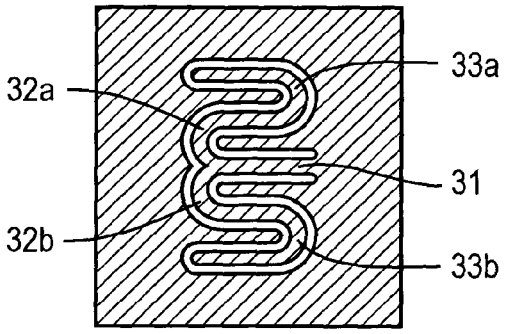
Figure 11D:
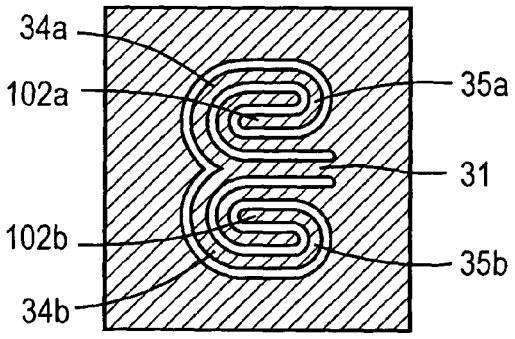

Similarly, there are shown examples of choosing an arcuate shape for the source portions of main line conductor 31 and the folded back parts of the already explained FIG. 5 in FIG. 11B, of the already explained FIG. 3C in FIG. 1C, and of the already explained FIG. 10C in FIG. 11D. By proceeding in this manner, it is possible to reduce the current density.

First Application Example

Figure 12:
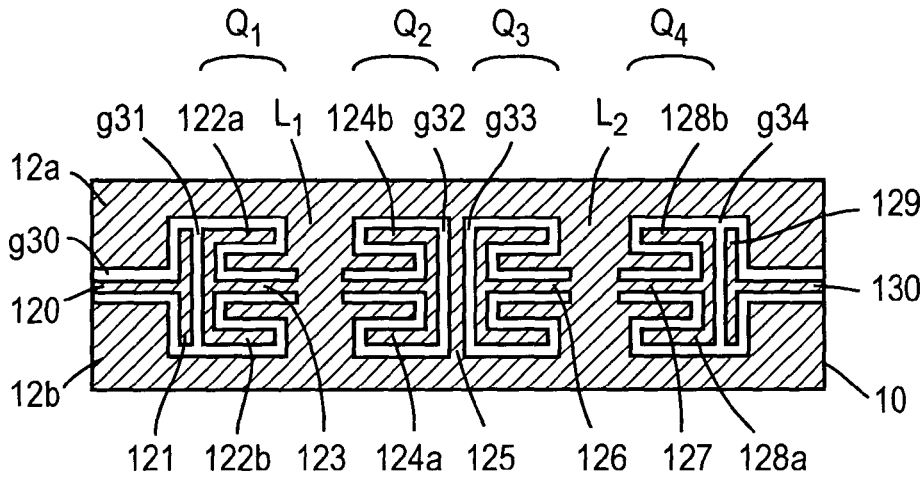
FIG. 12 is a diagram showing a filter constituted by connecting in series four λ/4 coplanar resonators of the type shown in FIG. 7 via sequential coupling parts.

In the following, there will be shown an example of a filter constituted by combining resonators which have been described in Embodiments 1 to 10, and the frequency characteristics thereof will be shown. The band pass filter shown below is a filter with Chebyshev characteristics which is designed to have a center frequency of 5 GHz, a bandwidth of 160 MHz, and an in-band ripple of 0.01 dB. In FIG. 12, there is shown a filter constituted by connecting in series four λ/4 resonators shown in FIG. 7 via sequential coupling parts. In the center portion of one longitudinal direction side of a rectangular shaped dielectric substrate 10, there is formed one end of an input/output terminal 120 which is extended in a longitudinal direction of dielectric substrate 10. On both outer sides, in the extension direction, of input/output terminal 120, there are arranged ground conductors 12*a* and 12*b* by leaving a spacing of gap g30.

To the other end of input/output terminal 120, there is connected an electrostatic electrode 121 having nearly the same length as input/output terminal 120 and which has the same line width as input/output terminal 120 and is facing in a direction at right angles with the longitudinal direction of rectangular shaped dielectric substrate 10. Electrostatic electrode 121 and ground conductors 12*a* and 12*b* also maintain a spacing of gap g30 between them.

On the opposite side of input/output terminal 120 of electrostatic electrode 121, a λ/4 resonator $Q_1$ explained in FIG. 7, leaving a spacing of gap g31, has auxiliary line conductors 122*a* and 122*b* arranged to face electrostatic electrode 121. The end on the side, facing away from auxiliary line conductors 122*a* and 122*b*, of main line conductor 123 of λ/4 resonator $Q_1$ is connected to an inductive coupling part $L_1$ connecting ground conductors 12*a* and 12*b*.

On the side of inductive coupling part $L_1$ facing away from λ/4 resonator $Q_1$, a λ/4 resonator $Q_2$ having the same shape as λ/4 resonator $Q_1$ is arranged to have one end of the main line conductor connected to inductive coupling part $L_1$. λ4 resonator $Q_2$ is arranged on dielectric substrate 10 in a direction inverted by 180° with respect to λ/4 resonator $Q_1$.

On the side, facing away from resonator $Q_1$, of auxiliary line conductors 124*a* and 124*b* of λ/4 resonator $Q_2$, there is left a spacing of a gap g32 and a short circuit line 125 connecting ground conductors 12*a* and 12*b*.

On the side, facing away from resonator $Q_1$, of short circuit line 125, there is left a spacing of a gap g33 and there is arranged a resonator $Q_3$ oriented in the same way as resonator $Q_1$. The end on the side, facing away from the auxiliary line conductors, of a main line conductor 126 of resonator $Q_3$ is connected to an inductive coupling part $L_2$ connecting ground conductors 12*a* and 12*b*. On the side, facing away from resonator $Q_1$, of inductive coupling part $L_2$, there is connected one end of a main line conductor 127 of a resonator $Q_4$ arranged with the same orientation as resonator λ/4 resonator $Q_2$.

On the side, facing away from resonator $Q_1$, of auxiliary line conductors 128*a* and 128*b* of resonator $Q_4$, there is left a spacing of a gap g34 and arranged an electrostatic electrode 129 having the same shape as electrostatic electrode 121 and an input/output terminal 130 is derived from the center portion of electrostatic electrode 129 to the center portion of the short side of rectangular shaped dielectric substrate 10 on the side facing away from resonator $Q_1$.

In the foregoing, as mentioned, λ/4 resonator $Q_1$ is connected to resonator $Q_2$ via inductive coupling part $L_1$, and resonator $Q_2$ is connected to resonator $Q_3$ via a capacitive coupling part formed by short circuit line 125. Resonator $Q_3$ is connected to resonator $Q_4$ via inductive coupling part $L_2$. In this way, four λ/4 resonators of the type shown in FIG. 7 are connected in series via coupling parts to constitute a filter. The total length of the filter shown in FIG. 12 is 20 mm, so as against the total length of 30 mm of the filter constituted by rectilinear shaped resonant elements of the type shown in FIG. 3A, it is possible to shorten it to approximately 66%.

Figure 13:
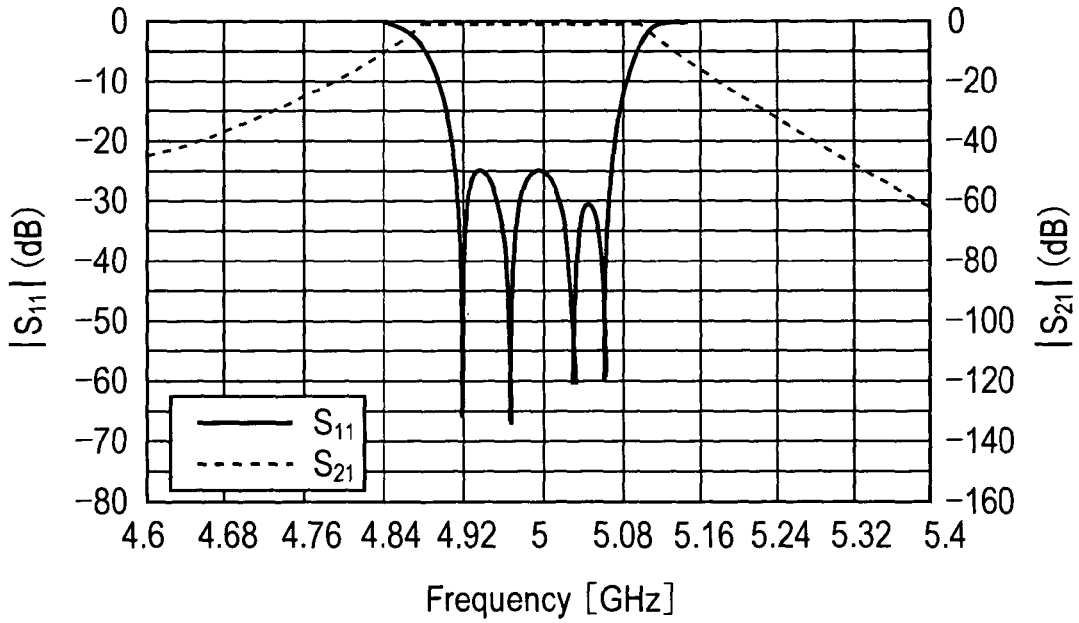
FIG. 13 is a diagram showing the frequency characteristics of the filter of FIG. 12.

The frequency characteristics of the filter shown in FIG. 12 are shown in FIG. 13. The abscissa of FIG. 13 represents frequency in GHz, one ordinate expresses in dB the S parameter $S_{11}$ expressing the fraction of reflection of the input signal, and the other ordinate expresses the S parameter $S_{21}$ in dB. Since the relationship of the abscissa and the ordinates of the frequency characteristics of the filters shown hereafter is the same as in this FIG. 13, an explanation of the diagram axes will hereafter be omitted.

The transfer characteristics of the filter are shown with a broken line. A center frequency of 4.995 GHz and a bandwidth at which half or more of the signal is transmitted of 238 MHz are shown. As for the bandwidth of 160 MHz in the design specification, $S_{21}$ is expressed to be in a range of −0.01 dB or higher. Within the aforementioned bandwidth of 238 MHz, $S_{11}$ shows a value of approximately −25 dB or lower.

Second Application Example

Figure 14:
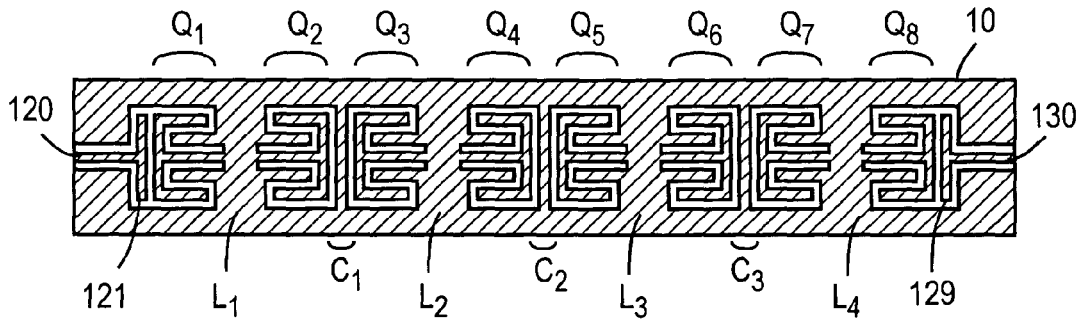
FIG. 14 is a diagram showing a filter constituted by connecting in series eight λ/4 coplanar resonators of the type shown in FIG. 7 via sequential coupling parts.

In FIG. 14, there is shown a plan view of a filter constituted by connecting in series eight λ/4 resonators of the type shown in FIG. 7. A detailed explanation of the connection relationships will be omitted and only the connection relationship of each resonator will be briefly explained. From one short side of rectangular shaped dielectric substrate 10, there is arranged a λ/4 resonator $Q_1$, shown in FIG. 7, via input/output terminal 120, and, toward the other short side, there are arranged, in order, inductive coupling part $L_1$, λ/4 resonator $Q_2$, capacitive coupling part $C_1$, λ/4 resonator $Q_3$, inductive coupling part $L_2$, λ/4 resonator $Q_4$, capacitive coupling part $C_2$, λ/4 resonator $Q_5$, inductive coupling part $L_3$, λ/4 resonator $Q_6$, capacitive coupling part $C_3$, λ/4 resonator $Q_7$, inductive coupling part $L_4$, λ4 resonator $Q_8$, and input/output terminal 130 to constitute a filter in which eight λ/4 resonators are connected in series.

Figure 15:
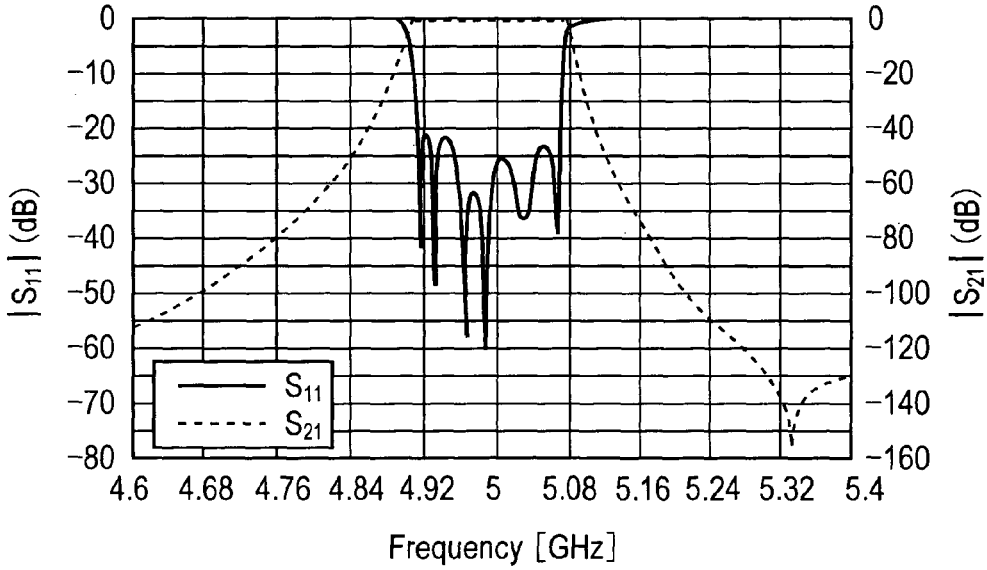
FIG. 15 is a diagram showing the frequency characteristics of the filter of FIG. 14.

The frequency characteristics of this filter are shown in FIG. 15. A center frequency of 4.998 GHz and a bandwidth at which half or more of the signal is transmitted of 177 MHz are shown. Since the blocking characteristics become sharper as the number of resonators constituting the filter increases, it also shows a value for the bandwidth which is closer than Application Example 1 to the design specification value of 160 MHz. $S_{11}$ also shows a value of approximately −21 dB or lower within the range of the 177 MHz bandwidth. As against the filter shown in FIG. 14 in which four λ/4 resonators are connected in series, the selectivity in frequency has become higher, to the extent that the number of λ/4 resonators connected in series has increased.

Third Application Example

Figure 16:
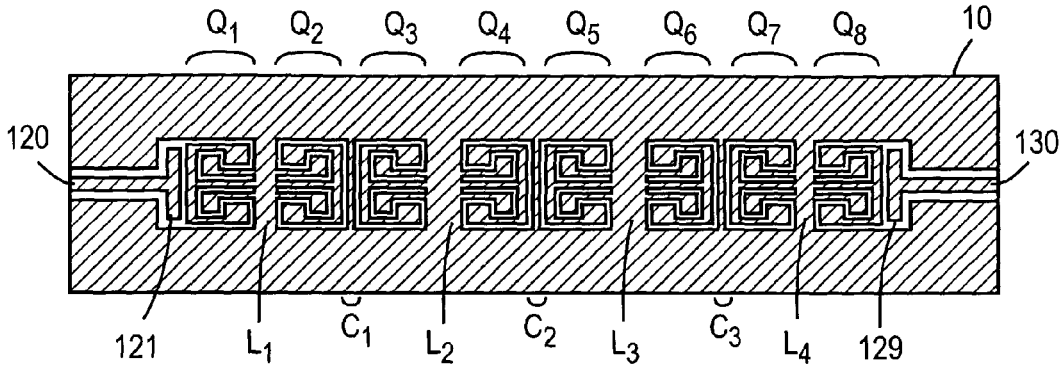
FIG. 16 is a diagram showing a filter constituted by connecting in series eight λ/4 coplanar resonators of the type shown in FIG. 10A via sequential coupling parts.

In FIG. 16, there is shown a plan view of a filter constituted by connecting in series eight λ/4 resonators wherein linear inserted ground conductor parts are further provided in resonant elements with a linear shape in which the clearance end parts of the auxiliary line conductors previously shown in FIG. 10A have a larger width.

Since the connection relationships between the λ/4 resonators are entirely the same as in the filter explained in FIG. 14, the reference numerals are taken to be the same and an explanation thereof is omitted.

Figure 17:
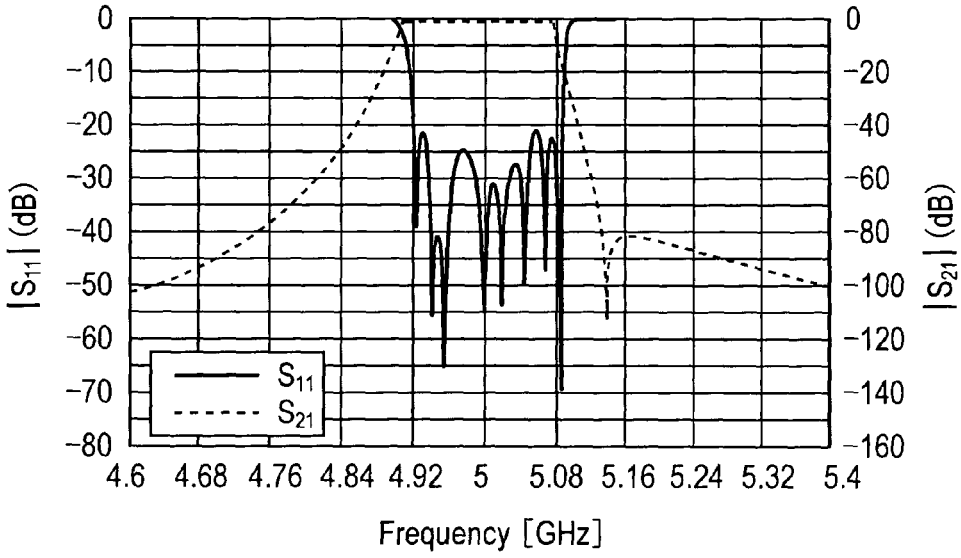
FIG. 17 is a diagram showing the frequency characteristics of the filter of FIG. 16.

The frequency characteristics of this filter are shown in FIG. 17. There is shown a center frequency of 5.001 GHz and a bandwidth of 176 MHz. Within the range of the 176 MHz bandwidth, $S_{11}$ shows a value of −21 dB or lower. The filter has nearly the same characteristics as the filter shown in FIG. 14.

Fourth Application Example

Figure 18:
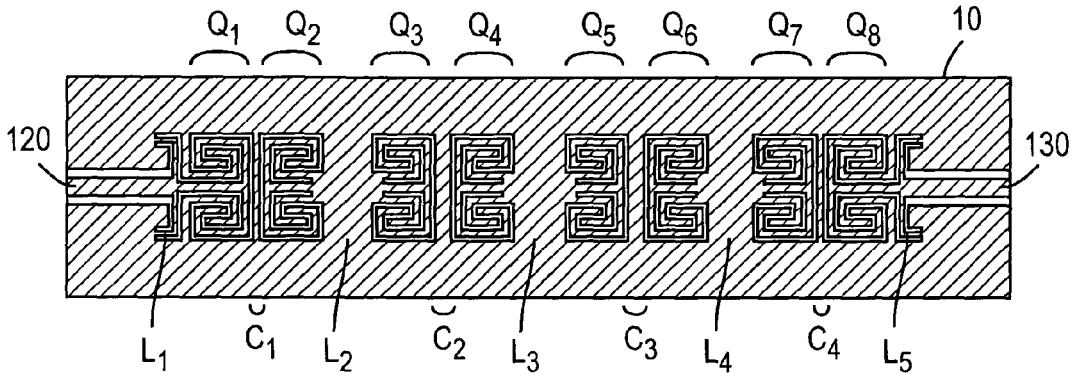
FIG. 18 is a diagram showing a filter constituted by connecting in series eight λ/4 coplanar resonators of the type shown in FIG. 10C via sequential coupling parts.

In FIG. 18, there is shown a plan view of a filter constituted by connecting in series eight λ/4 resonators of the type in which hook-shaped inserted ground conductor parts are provided in resonant elements in which vortex-shape auxiliary line conductors are formed by alternately reversing the direction of bending of auxiliary line conductors of the type previously shown in FIG. 10C.

The configuration in which eight λ/4 resonators are connected in series is the same as that of the filter explained in FIG. 14. One point is that, since the filter is constituted by inductive coupling parts to which input/output terminals 120 and 130 and the λ/4 resonators are connected by means of direct electrodes, the order of the coupling parts is different from that of FIG. 14. Only the connection relationship will be briefly explained.

From one short side of rectangular shaped dielectric substrate 10, input/output terminal 120 is connected by means of a direct electrode to inductive coupling part $L_1$, and inductive coupling part $L_1$ is connected directly to the main line conductor of λ/4 resonator $Q_1$ shown in FIG. 10C. Thereafter, a filter is constituted in which, towards the other short end, capacitive coupling part $C_1$, λ/4 resonator $Q_2$, inductive coupling part $L_2$, λ/4 resonator $Q_3$, capacitive coupling part $C_2$, λ/4 resonator $Q_4$, inductive coupling part $L_3$, λ/4 resonator $Q_5$, capacitive coupling part $C_3$, λ/4 resonator $Q_6$, inductive coupling part $L_4$, λ/4 resonator $Q_7$, capacitive coupling part $C_4$, λ/4 resonator $Q_8$, inductive coupling part $L_5$, and input/output terminal 130 are arranged in order, eight λ/4 resonators being connected in series.

Figure 19:
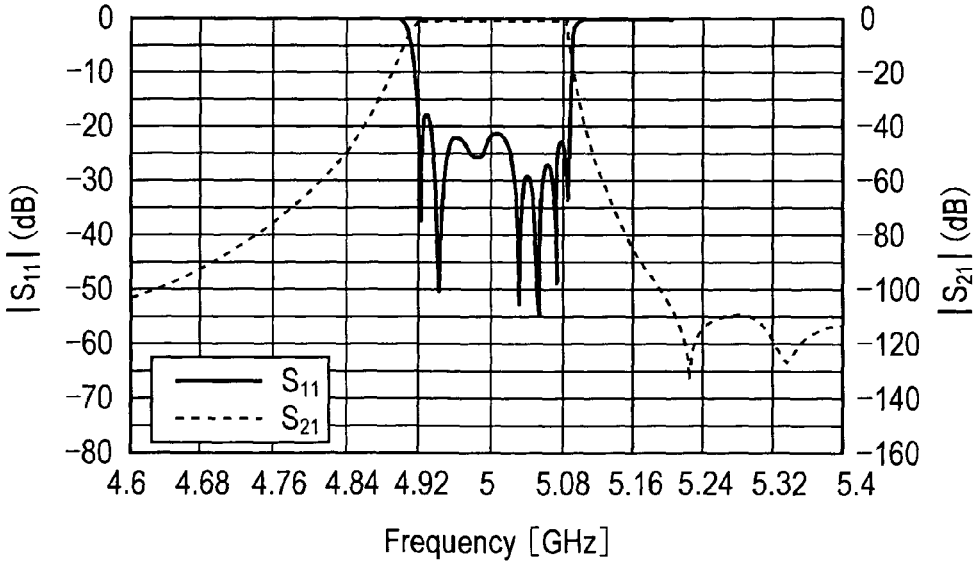
FIG. 19 is a diagram showing the frequency characteristics of the filter of FIG. 18.
Figure 20:
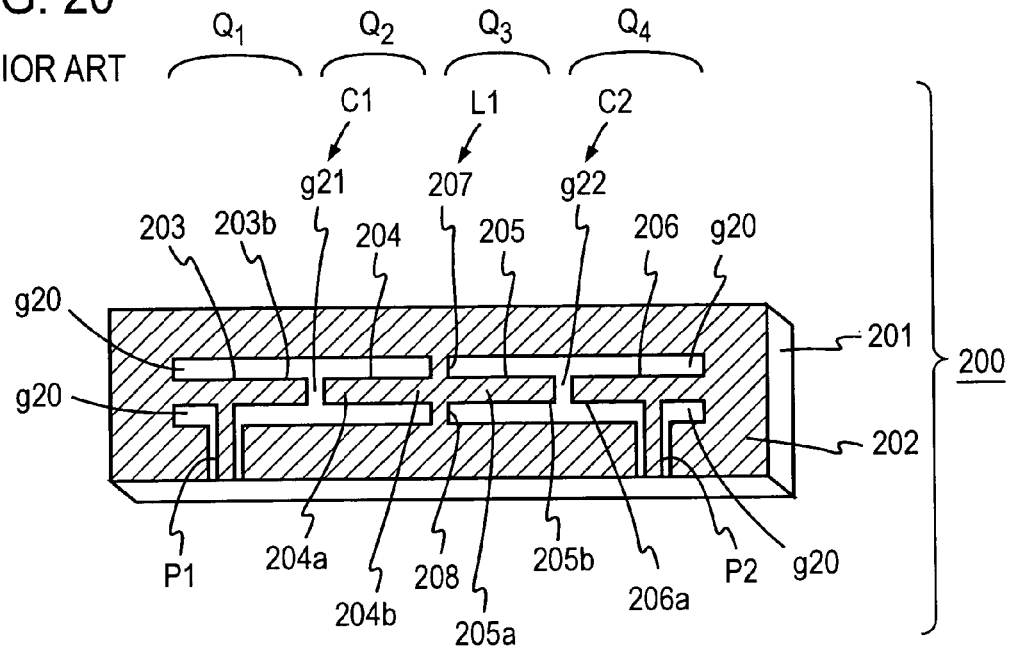
FIG. 20 PRIOR ART
FIG. 20 is a diagram showing a filter using coplanar lines shown in Patent Reference 1.
Figure 21:
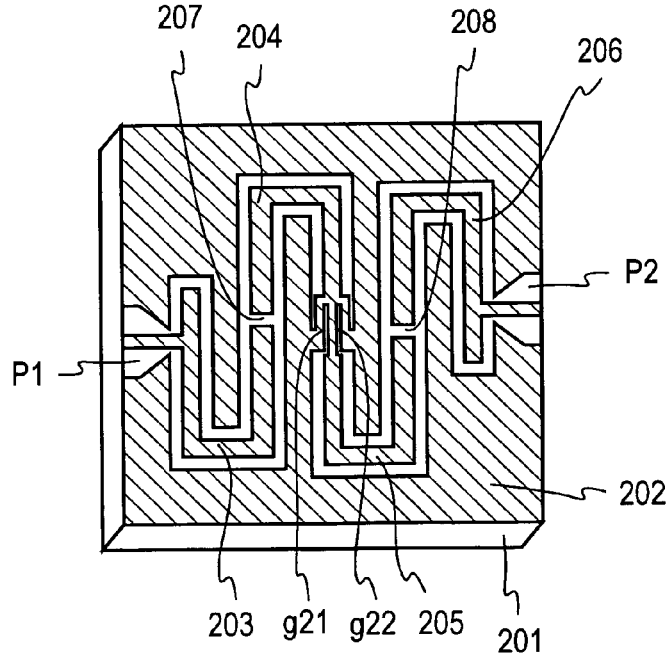
FIG. 21 PRIOR ART
FIG. 21 is a diagram showing a filter with a structure in which the center conductors have been lined up in meander shape.

The frequency characteristics of this filter are shown in FIG. 19. A center frequency of 5.005 GHz and a bandwidth of 177 MHz are shown. Within the range of the 177 MHz bandwidth, $S_{11}$ shows a value of approximately −18 dB or lower.

As mentioned above, even if a filter is constituted by using a resonator according to this invention, it is seen that it functions normally.

As has been mentioned above, since, due to a coplanar resonator of this invention, the center conductor consists of a line in which a main line conductor arranged in parallel with the direction of signal propagation is combined with auxiliary line conductors where at least one end portion of the same line conductor has been folded back, it is possible, to the extent of the contribution of the folded back auxiliary line conductors, to reduce the length of the resonator in the direction of signal propagation. This is because, compared to the method of choosing a structure in which the center conductor is lined up in a meander shape, which has gradually come to be carried out as one method of reducing the size of conventional coplanar resonators, the enlargement of the width in the direction at right angles with the direction of signal propagation is small. It is possible to obtain the same width sufficiently within the range of sizes for manufacturing a plane circuit on the surface of dielectric substrate 10 with good efficiency or the dimensions necessary to confer strength to the substrate.

Also, the method of making the conventional center conductor into a meander shape has had the problem that the design time required for electromagnetic field simulations used in the filter design increased due to the fact that the symmetry of the circuit pattern is lost. As against this, since the line conductor shape becomes one with line symmetry in the central axis of the center line in the longitudinal direction of the main line conductor which is the center line conductor, a resonator according to this invention establishes a magnetic wall and therefore the electromagnetic field distribution becomes symmetric. Consequently, the resonator according to this invention also has the effect of being able to shorten the time required for design since it is possible to reduce the domain of analysis to half.

What is claimed is:

1. A coplanar resonator including:

a dielectric substrate;

a center conductor formed on a top surface of said dielectric substrate and having a main line conductor formed by extension into a rectilinear shape having one end and another end on said top surface of said dielectric substrate and a first and a second auxiliary line conductor formed by bifurcating from said one end of said main line conductor and being folded back on both sides of said main line conductor, wherein to achieve a same resonant frequency of a single line conductor without bifurcation, the length of said main line conductor is shorter than a length of said single line conductor;

a pair of input/output terminals formed on said top surface of the dielectric substrate on both outer longitudinal sides of the main line conductor to extend on a line parallel with the main line conductor; and a ground conductor surrounding said center conductor and formed on said top surface of said dielectric substrate.

2. The coplanar resonator according to claim 1, wherein said first and second auxiliary line conductors are folded back a plurality of times.

3. The coplanar resonator according to claim 1, wherein inserted ground conductor parts formed by extension from said ground conductor are formed so as to penetrate into bays formed by the foldback of said first and second auxiliary line conductors and/or bays formed between said first and second auxiliary line conductors and said main line conductor.

4. The coplanar resonator according to claim 1, wherein, at the tips of said first and second auxiliary line conductors, there are formed wide-width parts which have a larger width than the first and second auxiliary line conductors.

5. The coplanar resonator according to claim 3, wherein, at the tip of each said inserted ground conductor, there is formed a wide-width part having a larger width than the inserted ground conductor.

6. The coplanar resonator according to claim 1, wherein said other end of said main line conductor is connected to said ground conductor.

7. The coplanar resonator according to claim 6, wherein the sides of at least the connection part of said main line conductor with respect to said ground conductor mutually widen in an arcuate shape toward the outer sides.

8. The coplanar resonator according to claim 1, wherein said center conductor includes a third and a fourth auxiliary line conductor formed by bifurcating from said other end of said main line conductor and being folded back to the outer sides of said main line conductor.

9. A coplanar filter wherein a plurality of the resonators according to claim 1 are connected in series via sequential coupling parts on said dielectric substrate.

* * * * *